US007672628B2

(12) United States Patent
Sato

(10) Patent No.: US 7,672,628 B2
(45) Date of Patent: Mar. 2, 2010

(54) POST-FIXING SUPPORT UNIT AND IMAGE FORMING APPARATUS USING THE SAME

(75) Inventor: Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 355 days.

(21) Appl. No.: 11/924,180

(22) Filed: Oct. 25, 2007

(65) Prior Publication Data

US 2008/0101830 A1 May 1, 2008

(30) Foreign Application Priority Data

Oct. 30, 2006 (JP) ..... 2006-293650

(51) Int. Cl.
*G03G 15/20* (2006.01)

(52) U.S. Cl. ..... 399/322; 399/405; 399/406

(58) Field of Classification Search ..... 399/122, 399/320, 322, 323, 400, 405, 406; 271/220, 271/272, 902

See application file for complete search history.

(56) References Cited

U.S. PATENT DOCUMENTS 5,288,062 A * 2/1994 Rizzolo et al. ..... 270/58.12
5,758,252 A * 5/1998 Enomoto et al. ..... 399/407
6,292,650 B1 * 9/2001 Akiyama ..... 399/401
6,678,496 B1 * 1/2004 Aslam et al. ..... 399/323

FOREIGN PATENT DOCUMENTS

| | | |
|---|---|---|
| JP | 08-324863 | 12/1996 |
| JP | 09-086752 | 3/1997 |
| JP | 2003-076182 | 3/2003 |
| JP | 2004-189368 | 7/2004 |

* cited by examiner

*Primary Examiner*—Hoan H Tran
(74) *Attorney, Agent, or Firm*—Hogan & Hartson LLP

(57) ABSTRACT

A post-fixing support unit which is disposed between a fixing roller including a heating roller having a heat generator and a pressure roller so disposed opposite to the heating roller as to form a nip portion and a plurality of sheet discharge rollers which are disposed on the downstream side relative to the fixing roller and corrugation rollers disposed respectively between the adjacent two sheet discharge rollers, such that the post-fixing support unit is located on the upstream side relative to the corrugation rollers at the same position as at least the corrugation rollers in the width direction.

8 Claims, 7 Drawing Sheets

POST-FIXING SUPPORT UNIT AND IMAGE FORMING APPARATUS USING THE SAME

CROSS-REFERENCE TO RELATED APPLICATIONS

This application is based upon and claims the benefit of priority from prior Japanese Patent Application No. 2006-293650, filed Oct. 30, 2006, the entire contents of which are incorporated herein by reference.

BACKGROUND OF THE INVENTION

1. Field of the Invention

The present invention particularly relates to a post-fixing support unit using a corrugation roller as a sheet discharge roller and an image forming apparatus using the post-fixing support unit.

2. Description of the Related Art

Generally, a toner image forming means of an electrophotographic type includes a photoconductor serving as an image carrier and having a photosensitive layer on the outer circumferential surface thereof, a charge means for uniformly charging the outer circumferential surface of the photoconductor, an exposure means for selectively exposing the uniformly charged outer circumferential surface to form an electrostatic latent image, and a development means for supplying toner which is developer to the electrostatic latent image formed by the exposure means to form a visible image (toner image).

As an image forming apparatus of a rotary type for forming a color image, there is known an intermediate transfer belt type color image forming apparatus, in which the toner image forming means as described above is disposed opposite to an intermediate transfer belt. In this configuration, toner images on the photoconductors formed by the toner image forming means are sequentially transferred onto the intermediate transfer belt to superimpose toner images of a plurality of colors (e.g., yellow, cyan, magenta, and black) on the intermediate transfer belt, whereby a color image is obtained on the intermediate transfer belt.

As a sheet discharge unit of the image forming apparatus having the configuration described above, there is known one in which there is provided a means for forcibly forming a surface corrugation on a completed hard copy at the sheet discharge position so as to increase the strength of the recording medium (refer to JP-A-8-324863).

Further, there is known a discharge unit provided with a plurality of driven rolls which are supported by a rotary shaft so as to be rotated independently of a plurality of discharge rolls and each of which has a diameter larger than each of the discharge rolls (refer to JP-A-2004-189368).

In the inventions disclosed in JP-A-8-324863 and JP-A-2004-189368, corrugation rollers are used to cause width direction waving on a recording sheet to increase the strength of the recording sheet, thus ensuring stackability thereof. However, in this environment, when a change of the sheet discharge direction to the face-down direction in a space-saving type system is carried out, curves are generated in two directions on the recording sheet, with the result that folding, puckering, wrinkling, and the like are generated on the recording sheet.

SUMMARY OF THE INVENTION

The present invention has been made in view of the above problems resided in prior arts, and an object thereof is to provide a post-fixing support unit capable of suppressing folding, puckering, wrinkling, and the like on the recording sheet from occurring at the sheet discharging time.

To achieve the above object, a post-fixing support unit according to the present invention is disposed between a fixing roller including a heating roller having a heat generator and a pressure roller so disposed opposite to the heating roller as to form a nip portion and a plurality of sheet discharge rollers which are disposed on the downstream side relative to the fixing roller and corrugation rollers disposed respectively between the adjacent two sheet discharge rollers, such that the post-fixing support unit is located on the upstream side relative to the corrugation rollers at the same position as at least the corrugation rollers in the width direction. With this configuration, it is possible to suppress folding, puckering, wrinkling, and the like on the recording sheet from occurring at the sheet discharging time.

The post-fixing support unit is disposed near an intersection of a tangent line extending from a nip portion of the fixing roller and tangent line extending from a nip portion of the sheet discharge roller. With this configuration, it is possible to suppress folding, puckering, wrinkling, and the like on the recording sheet from occurring at the sheet discharging time.

The post-fixing support unit includes a post-fixing support guide. With this configuration, it is possible to suppress folding, puckering, wrinkling, and the like on the recording sheet from occurring at the sheet discharging time with a simple structure and at low cost.

The post-fixing support unit includes a post-fixing support roller. With this configuration, it is possible to suppress folding, puckering, wrinkling, and the like on the recording sheet from occurring at the sheet discharging time with a simple structure and at low cost.

The post-fixing support roller is disposed only on one side of a transfer medium feeding path. With this configuration, it is possible to suppress folding, puckering, wrinkling, and the like on the recording sheet from occurring at the sheet discharging time with a simple structure and at low cost.

The post-fixing support unit includes support guide ribs. With this configuration, it is possible to suppress folding, puckering, wrinkling, and the like on the recording sheet from occurring at the sheet discharging time with a simple structure and at low cost.

The support guide ribs are disposed only on one side of a transfer medium feeding path. With this configuration, it is possible to suppress folding, puckering, wrinkling, and the like on the recording sheet from occurring at the sheet discharging time with a simple structure and at low cost.

Further, an image forming apparatus according to the present invention includes: an image carrier; a developer carrier for developing a latent image on the image carrier; an intermediate transfer member for transferring the image on the image carrier developed by the developer carrier; a secondary transfer section for transferring the image on the intermediate transfer member onto a transfer medium; a fixing unit for fixing the image on the transfer medium; and the post-fixing support unit. With this configuration, it is possible to suppress folding, puckering, wrinkling, and the like on the recording sheet from occurring at the sheet discharging time.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

The invention will be described with reference to the accompanying drawings, wherein like numbers reference like elements.

DETAILED DESCRIPTION OF THE PREFERRED EMBODIMENTS

Figure 1:
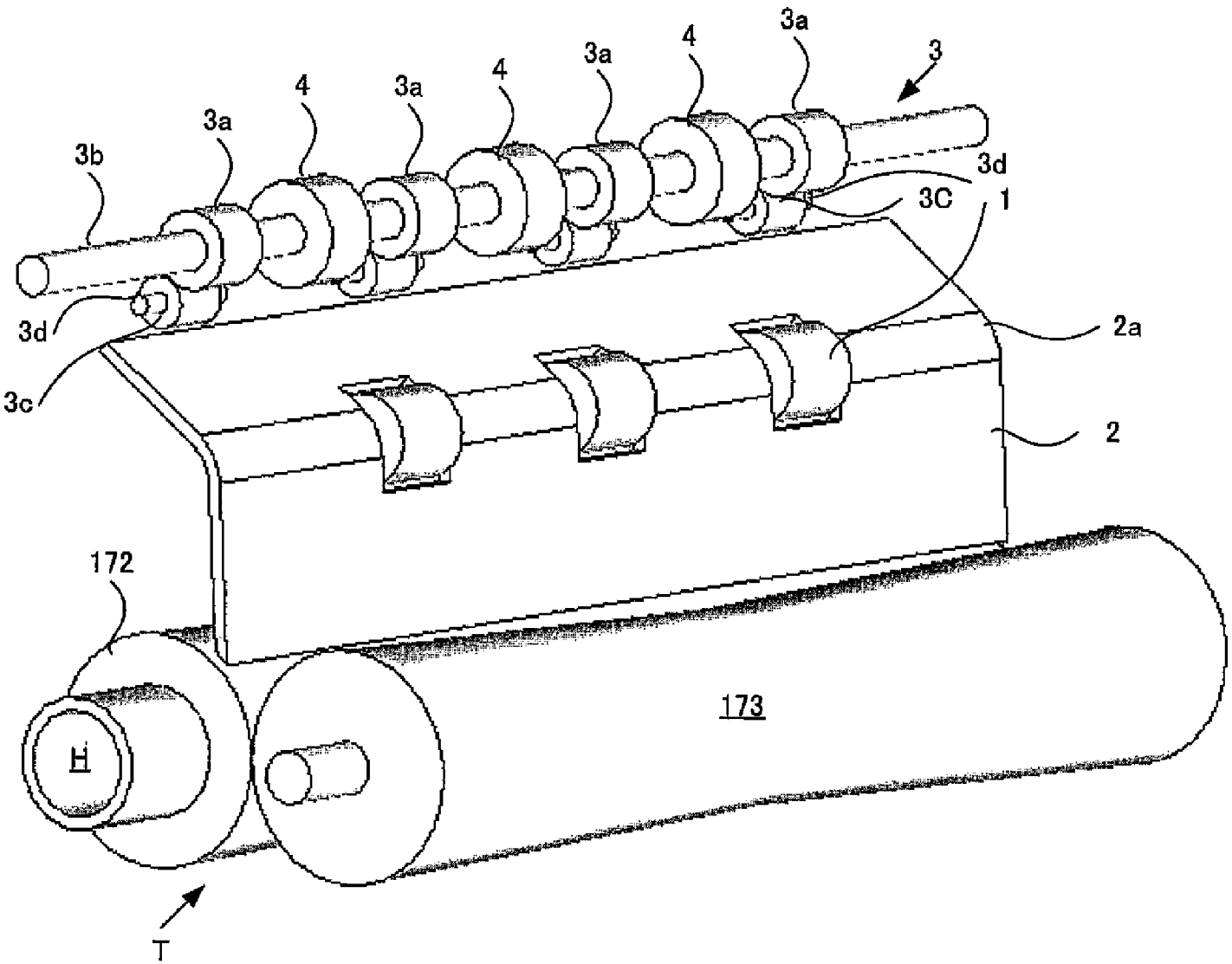
FIG. 1 is a perspective view showing a first embodiment.

Embodiments of the present invention will be described below with reference to the accompanying drawings. FIG. 1 is a perspective view of a first embodiment of a post-fixing support unit. In the drawing, a reference symbol T denotes a fixing roller, 172 denotes a heating roller, H denotes a heater, 173 denotes a pressure roller, 1 denotes post-fixing support rollers which are one example of a post-fixing support unit, 2 denotes a post-fixing support guide which is one example of a post-fixing support unit, 2*a* denotes a curved portion, 3 denotes a sheet discharge roller unit, 3*a* denotes driving sheet discharge rollers, 3*b* denotes a driving sheet discharge roller shaft, 3*c* denotes driven sheet discharge rollers, 3*d* denotes a driven sheet discharge roller shaft, and 4 denotes corrugation rollers.

The fixing roller T is composed of the heating roller 172 and pressure roller 173. The heating roller 172 incorporates the heater H and is rotatably supported at its both ends. The pressure roller 173 is disposed in parallel with the heating roller 172 and has a reversed crown shape in which the outer diameter of each of the both ends thereof is larger than that of the center portion. Like the heating roller 172, the pressure roller 173 is rotatably supported at its both ends.

The sheet discharge roller unit 3 includes a plurality of driving sheet discharge rollers 3*a* supported by and arranged along the driving sheet discharge roller shaft 3*b* at a predetermined interval from one another, a plurality of driven sheet discharge rollers 3*c* which are rotatably supported by the driven sheet discharge roller shaft 3*d* and so disposed opposite to the driving sheet discharge rollers 3*a* as to hold a recording sheet S (transfer medium) between themselves and driving sheet discharge rollers 3*a*, and corrugation rollers 4 disposed respectively between the adjacent two driving sheet discharge rollers 3*a*.

Figure 2:
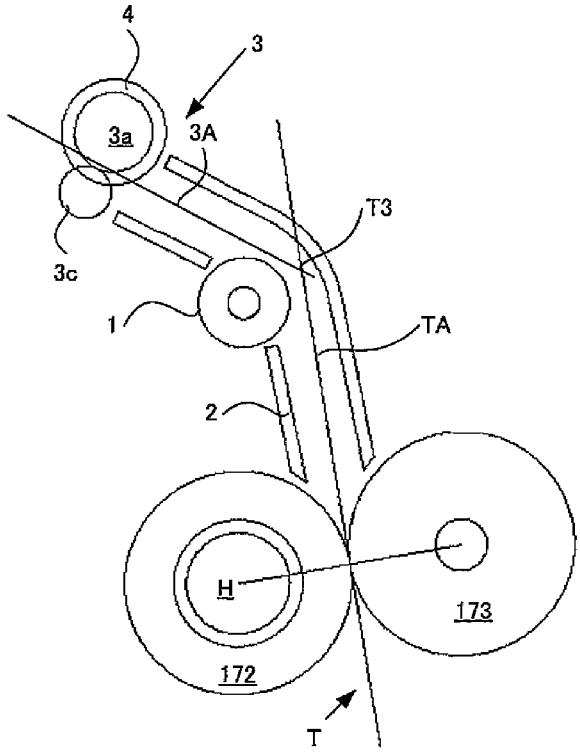
FIG. 2 is a cross-sectional view showing the first embodiment.

FIG. 2 is a cross-sectional view of the post-fixing support rollers 1 and post-fixing support guide 2. As shown in FIGS. 1 and 2, the post-fixing support guide 2 is so provided as to guide the recording sheet S from the fixing roller T to sheet discharge roller unit 3. The post-fixing support guide 2 has a curved portion 2*a* for changing the sheet discharge direction to the face-down direction in a space-saving manner so as to achieve downsizing of the apparatus. The post-fixing support rollers 1 are provided at the curved portion 2*a* formed in the midway of the post-fixing support guide 2. That is, the post-fixing support rollers 1 are arranged at a position which is located on one side of and near an intersection T3 of a tangent line TA extending from a nip portion of the fixing roller T and tangent line 3A extending from a nip portion of the sheet discharge roller unit 3.

Figure 3:
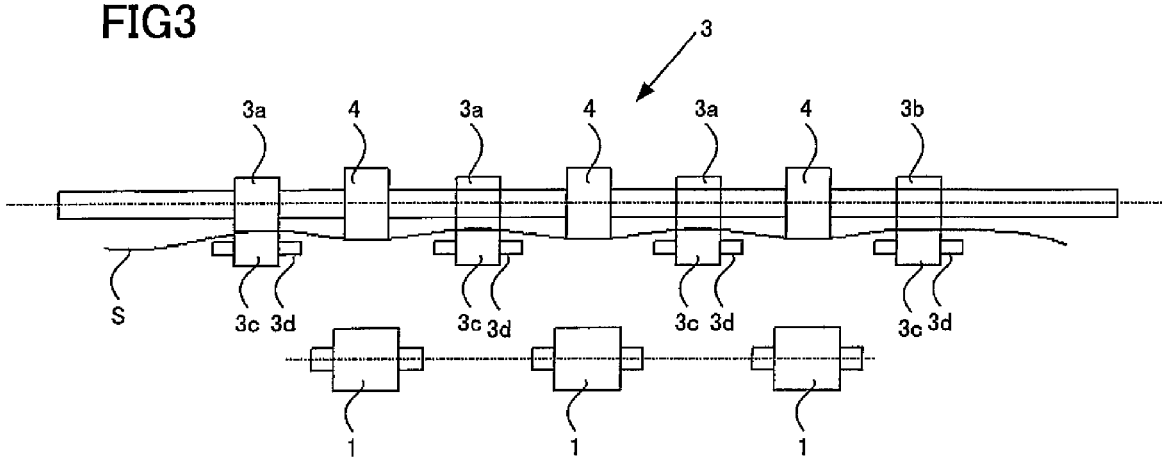
FIG. 3 is a view showing an arrangement relationship of the first embodiment.

FIG. 3 is a view showing an arrangement relationship between the post-fixing support rollers 1 and sheet discharge roller unit 3. As shown in FIG. 3, a part of the outer circumference of each of the corrugation rollers 4 of the sheet discharge roller unit 3 protrudes, relative to the outer circumference of each of the driving sheet discharge rollers 3*a*, toward the driven sheet discharge rollers 3*c* side. Accordingly, when the recording sheet S is discharged by the sheet discharge roller unit 3, the corrugation rollers 4 pressure contact the recording sheet S to deform it to cause waving. The respective post-fixing support rollers 1 are disposed at the same position in the width direction as the respective corrugation rollers 4 on the downstream side relative to the corrugation rollers 4. The direction in which the post-fixing support rollers 1 come into contact with the recording sheet S is opposite to the direction in which the corrugation rollers 4 come into contact with the recording sheet S.

A feeding state of the recording sheet S from the fixing roller T to sheet discharge roller unit 3 will be described. The recording sheet S onto which a toner image has been thermally fixed by the heating roller 172 is fed from between the heating roller 172 and pressure roller 173, passed through the post-fixing support guide 2, and guided to the sheet discharge roller unit 3. At this time, the recording sheet S is curved by the post-fixing support guide 2 and brought into contact with the post-fixing support rollers 1 formed at the curved portion 2*a*. Subsequently, the front side of the recording sheet S enters the sheet discharge roller unit 3. At this time, the recording sheet S is held between the corrugation rollers 4 and sheet discharge roller unit 3, thereby deforming the recording sheet S to cause waving. However, the rear side of the recording sheet S is brought into contact with the post-fixing support rollers 1 in the direction opposite to the direction in which the rear side of the recording sheet S is brought into contact with the corrugation rollers 4. Therefore, waving of the recording sheet S formed at the curved portion 2*a* can be reduced. After that, the recording sheet S is passed through the curved portion 2*a* and fed by the sheet discharge roller unit 3 so as to be discharged to a sheet discharge tray.

As described above, the post-fixing support guide 2 is provided between the fixing roller T and sheet discharge roller unit 3, as well as the post-fixing support rollers 1 are provided at the curved portion 2*a* of the post-fixing support guide 2. With this configuration, occurrence of folding, puckering, wrinkling, and the like on the recording sheet S can be suppressed.

Figure 4:
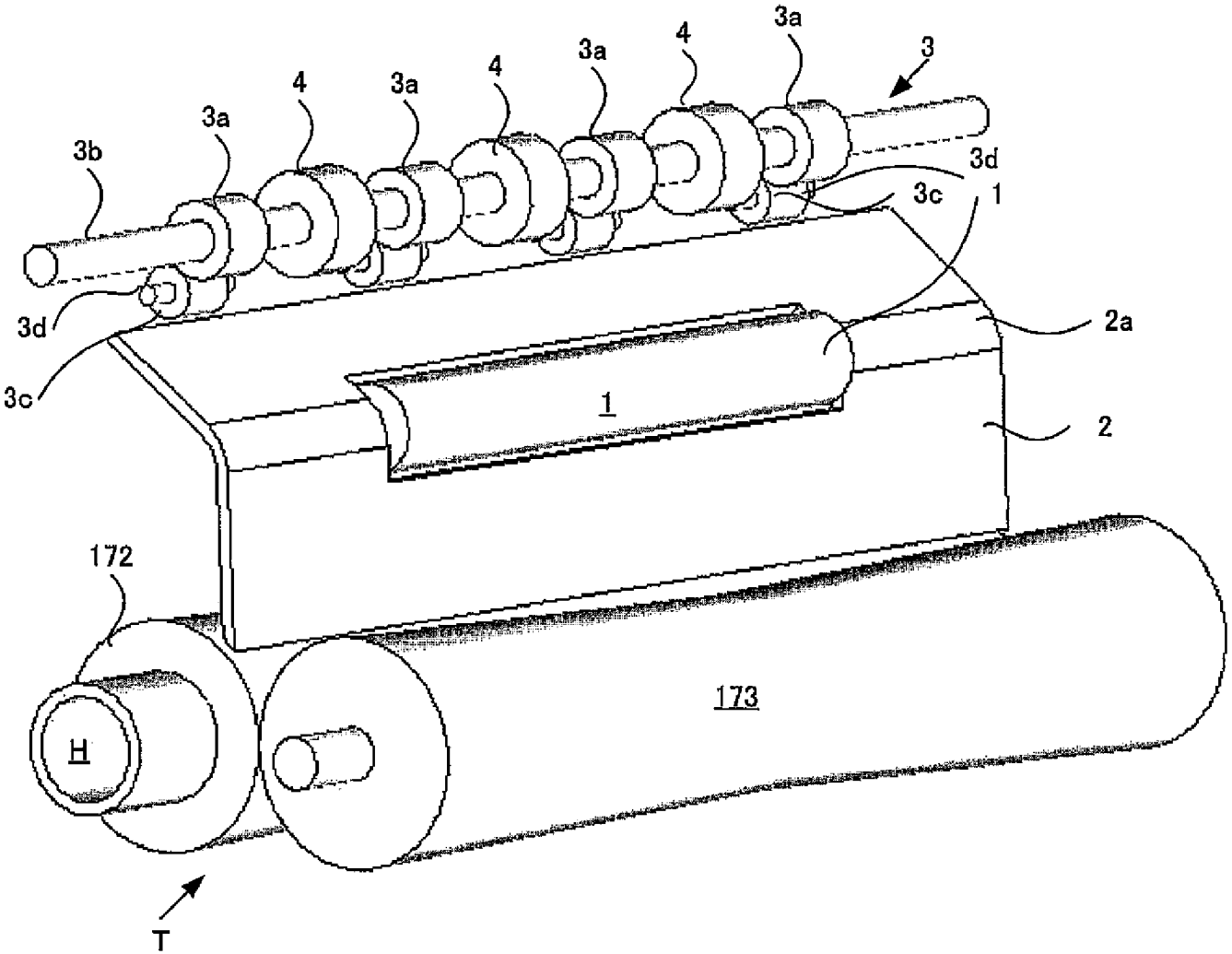
FIG. 4 is a perspective view showing a second embodiment.

A second embodiment will next be described. FIG. 4 is a perspective view showing a second embodiment of the post-fixing support unit. In this embodiment, the post-fixing support roller 1 is formed by one cylindrical roller.

The post-fixing support guide 2 is so provided as to guide the recording sheet S from the fixing roller T to sheet discharge roller unit 3. The post-fixing support guide 2 has a curved portion 2*a* for changing the sheet discharge direction to the face-down direction in a space-saving manner so as to achieve downsizing of the entire apparatus. The post-fixing support roller 1 is provided at the curved portion 2*a* formed in the midway of the post-fixing support guide 2. That is, the post-fixing support roller 1 is formed by one cylindrical roller and arranged at a position which is located on one side of and near an intersection T3 of a tangent line TA extending from a nip portion of the fixing roller T and tangent line 3A extending from a nip portion of the sheet discharge roller unit 3. Further, the post-fixing support roller 1 is so disposed as to cover the position corresponding to the corrugation rollers 4.

Figure 5:
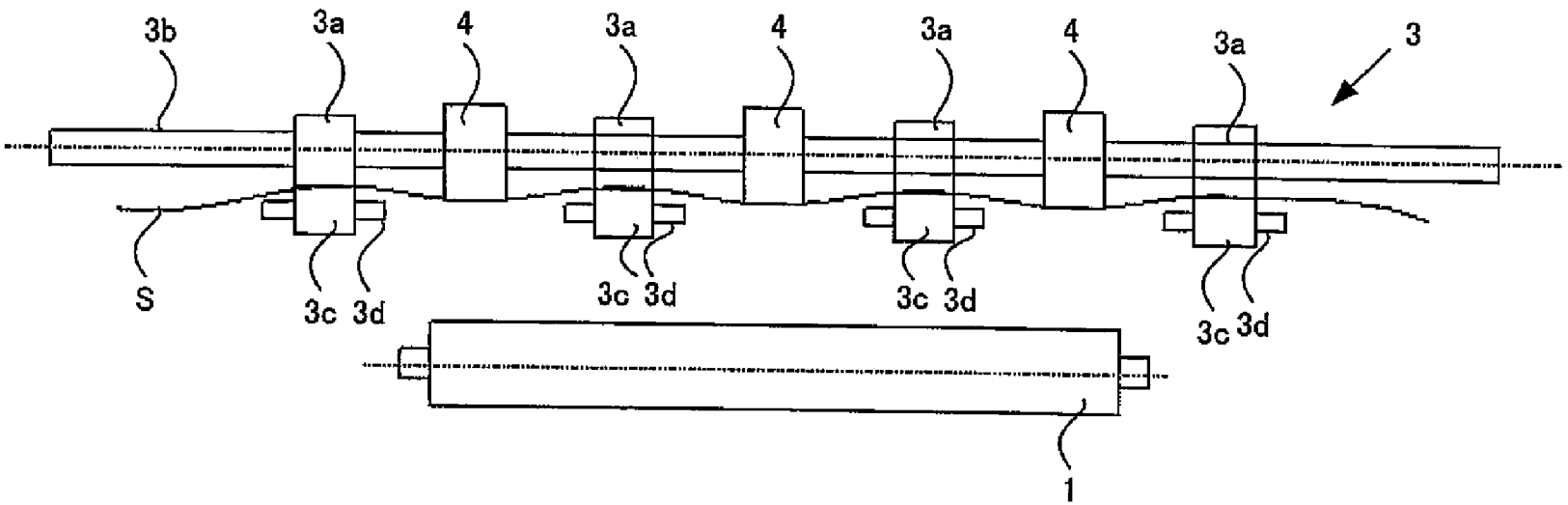
FIG. 5 is a view showing an arrangement relationship of the second embodiment.

FIG. 5 is a view showing an arrangement relationship between the post-fixing support roller 1 and sheet discharge roller unit 3. As shown in FIG. 5, a part of the outer circumference of each of the corrugation rollers 4 of the sheet discharge roller unit 3 protrudes, relative to the outer circumference of each of the driving sheet discharge rollers 3*a*, toward the driven sheet discharge rollers 3*c* side. Accordingly, when the recording sheet S is discharged by the sheet discharge roller unit 3, the corrugation rollers 4 pressure contact the recording sheet S to deform it to cause waving. The post-fixing support roller 1 is so disposed on the upstream side relative to the corrugation rollers 4 as to cover the position corresponding to the corrugation rollers 4. The direction in which the post-fixing support roller 1 comes into contacts with the recording sheet S is opposite to the direction in which the corrugation rollers 4 come into contact with the recording sheet S.

A feeding state of the recording sheet S from the fixing roller T to sheet discharge roller unit 3 will be described. The recording sheet S onto which a toner image has been thermally fixed by the heating roller 172 is fed from between the heating roller 172 and pressure roller 173, passed through the post-fixing support guide 2, and guided to the sheet discharge roller unit 3. At this time, the recording sheet S is curved by the post-fixing support guide 2 and brought into contact with the post-fixing support roller 1 formed at the curved portion 2*a*. Subsequently, the front side of the recording sheet S enters the sheet discharge roller unit 3. At this time, the recording sheet S is held between the corrugation rollers 4 and sheet discharge roller unit 3, thereby deforming the recording sheet S to cause waving. However, the rear side of the recording sheet S is brought into contact with the post-fixing support roller 1 in the direction opposite to the direction in which the rear side of the recording sheet S is brought into contact with the corrugation rollers 4. Therefore, waving of the recording sheet S formed at the curved portion 2*a* can be reduced. After that, the recording sheet S is passed through the curved portion 2*a* and fed by the sheet discharge roller unit 3 so as to be discharged to a sheet discharge tray.

As described above, the post-fixing support guide 2 is provided between the fixing roller T and sheet discharge roller unit 3, as well as the post-fixing support rollers 1 are provided at the curved portion 2*a* of the post-fixing support guide 2. With this configuration, occurrence of folding, puckering, wrinkling, and the like on the recording sheet S can be suppressed.

Figure 6:
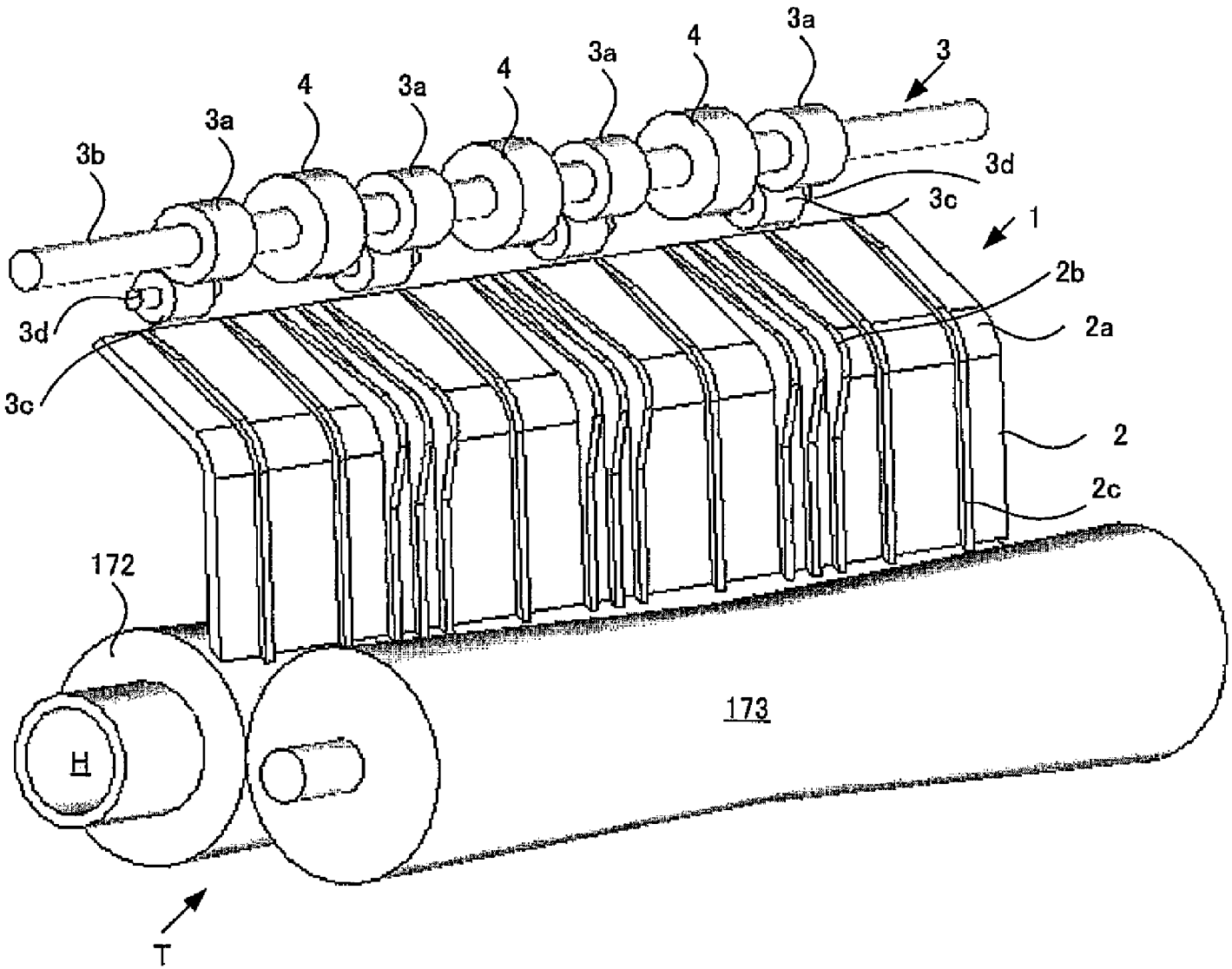
FIG. 6 is a perspective view showing a third embodiment.

A third embodiment will next be described. FIG. 6 is a perspective view showing a third embodiment of the post-fixing support unit. In the drawing, a reference numeral 2 denotes the post-fixing support guide, 2*b* denotes first support guide ribs, and 2*c* denotes second support guide ribs. In this embodiment, the support guide ribs 2*b* and 2*c* are formed on the post-fixing support guide 2 and so disposed as to cover the position corresponding to the corrugation rollers 4. More preferably, the heights of the first support guide ribs 2*b* whose positions correspond to the respective corrugation rollers 4 are made greater than those of the second support guide ribs 2.

Figure 7:
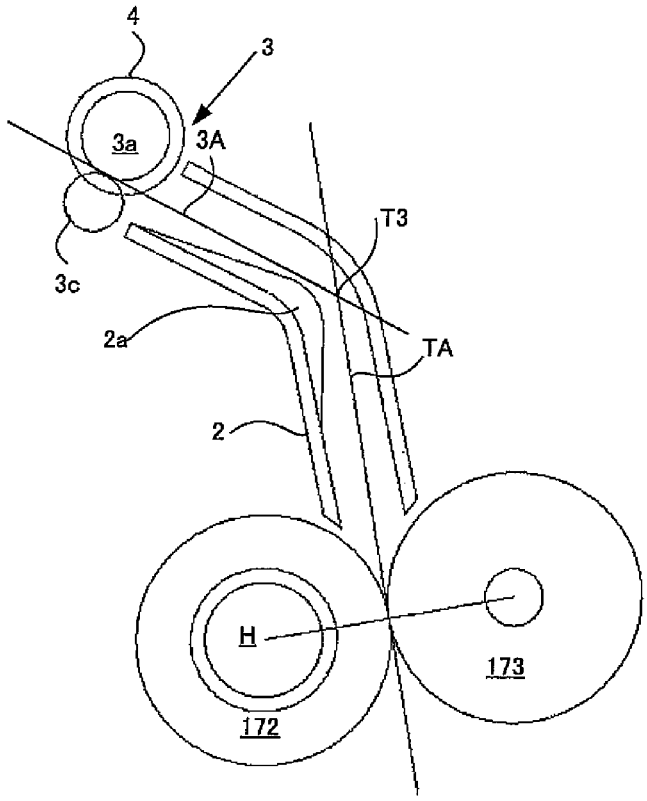
FIG. 7 is a cross-sectional view showing the third embodiment.

FIG. 7 is a cross-sectional view showing the post-fixing support guide 2. As shown in FIG. 7, the post-fixing support guide 2 is so provided as to guide the recording sheet S from the fixing roller T to sheet discharge roller unit 3. The post-fixing support guide 2 has a curved portion 2*a* for changing the sheet discharge direction to the face-down direction in a space-saving manner so as to achieve downsizing of the apparatus. The support guide ribs 2*b* and 2*c* are provided at the curved portion 2*a*. That is, the support guide ribs 2*b* and 2*c* are arranged at a position which is located on one side of and near an intersection T3 of a tangent line TA extending from a nip portion of the fixing roller T and tangent line 3A extending from a nip portion of the sheet discharge roller unit 3. Further, the support guide ribs 2*b* and 2*c* are so disposed as to cover the position corresponding to the corrugation rollers 4.

Figure 8:
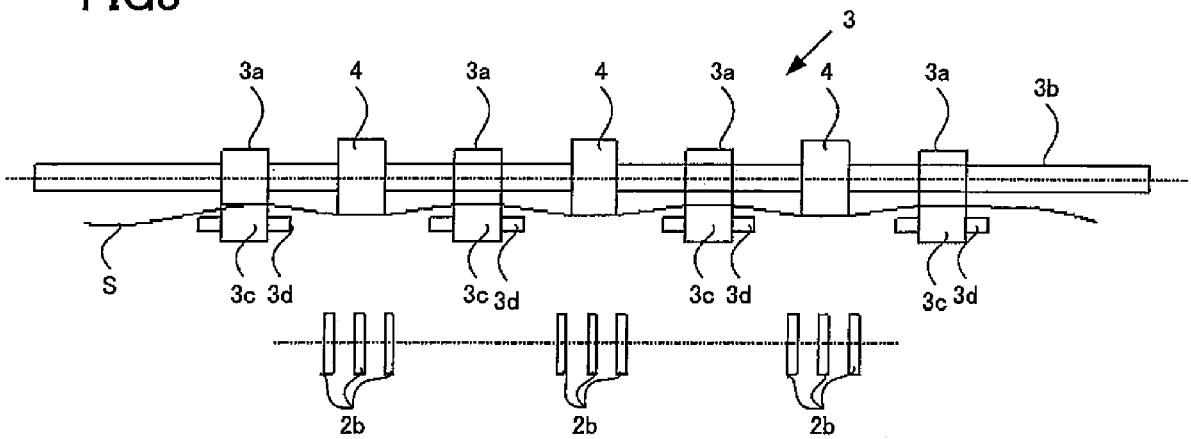
FIG. 8 is a view showing an arrangement relationship of the third embodiment.

FIG. 8 is a view showing an arrangement relationship between the support guide ribs 2*b*, 2*c* and sheet discharge roller unit 3. As shown in FIG. 8, a part of the outer circumference of each of the corrugation rollers 4 of the sheet discharge roller unit 3 protrudes, relative to the outer circumference of each of the driving sheet discharge rollers 3*a*, toward the driven sheet discharge rollers 3*c* side. Accordingly, when the recording sheet S is discharged by the sheet discharge roller unit 3, the corrugation rollers 4 pressure contact the recording sheet S to deform it to cause waving. The support guide ribs 2*b* and 2*c* are so disposed on the upstream side relative to the corrugation rollers 4 in the area including the positions of the same phase as those of the corrugation rollers 4. The direction in which the support guide ribs 2*b* and 2*c* come into contact with the recording sheet S is opposite to the direction in which the corrugation rollers 4 come into contact with the recording sheet S. More preferably, the first support guide ribs 2*b* are disposed in the area including the positions of the same phase as those of the corrugation rollers 4.

A feeding state of the recording sheet S from the fixing roller T to sheet discharge roller unit 3 will be described. The recording sheet S onto which a toner image has been thermally fixed by the heating roller 172 is fed from between the heating roller 172 and pressure roller 173, passed through the post-fixing support guide 2, and guided to the sheet discharge roller unit 3. At this time, the recording sheet S is curved by the post-fixing support guide 2 and brought into contact with the support guide ribs 2*b* and 2*c* at the curved portion 2*a*. Subsequently, the front side of the recording sheet S enters the sheet discharge roller unit 3. At this time, the recording sheet S is held between the corrugation rollers 4 and sheet discharge roller unit 3, thereby deforming the recording sheet S to cause waving. However, the rear side of the recording sheet S is brought into contact with the support guide ribs 2*b* and 2*c* at the curved portion 2*a* in the direction opposite to the direction in which the rear side of the recording sheet S is brought into contact with the corrugation rollers 4. Therefore, waving of the recording sheet S formed at the curved portion 2*a* can be reduced. After that, the recording sheet S is passed through the curved portion 2*a* and fed by the sheet discharge roller unit 3 so as to be discharged to a sheet discharge tray.

As described above, the support guide ribs 2*b* and 2*c* are provided at the curved portion 2*a* formed between the fixing roller T and sheet discharge roller unit 3. With this configuration, occurrence of folding, puckering, wrinkling, and the like on the recording sheet S can be suppressed.

Figure 9:
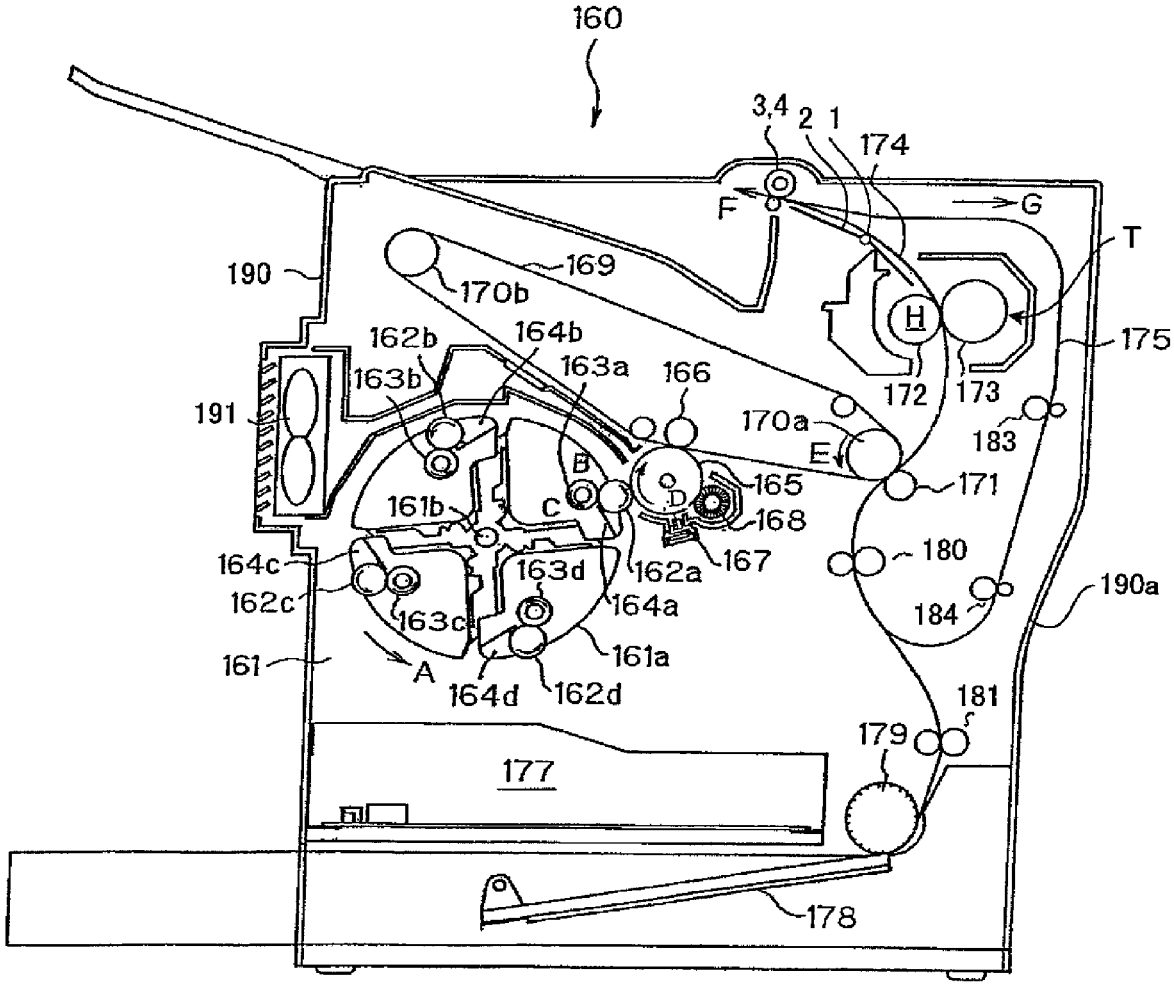
FIG. 9 is a vertical cross-sectional side view showing an image forming apparatus according to an embodiment the present invention.

FIG. 9 is a vertical cross-sectional side view of an image forming apparatus to which the present invention is applied. In FIG. 9, an image forming apparatus 160 includes, as main component parts, a rotary-type developing unit 161, a photosensitive drum 165 functioning as an image carrier, an image writing means (line head) 167 having an organic EL array, an intermediate transfer belt 169 serving as an intermediate transfer member, a sheet feeding path 174, a heating roller 172 of the fixing unit, and a sheet supply tray 178.

In the developing unit 161, a developing rotary 161*a* is rotated in the direction of an arrow A about a shaft 161*b*. The inside of the developing rotary 161*a* is divided into four parts in which image forming units of four colors (yellow (Y), cyan (C), magenta (M), and black (K)) are respectively provided. Reference symbols 162*a* to 162*d* denote developing rollers serving as toner carriers which are respectively provided in the image forming units of four colors and which are rotated in the direction of an arrow B. Reference numerals 163*a* to 163*d* denote toner supply roller which are rotated in the direction of an arrow C. Reference numerals 164*a* to 164*d* are restricting blades for restricting the thickness of toner.

The photosensitive drum 165 is driven by a not shown driving motor such as a stepping motor in the direction of an arrow D which is opposite direction to the rotational direction of the developing roller 162*a*. The intermediate transfer belt 169 is wound around a driven roller 170*b* and a driving roller 170*a*. The driving roller 170*a* is connected to a driving motor of the photosensitive drum 165, thereby providing a driving force to the intermediate transfer belt 169. The drive of the driving motor causes the driving roller 170*a* of the intermediate transfer belt 169 to be rotated in the direction of an arrow E which is opposite direction to the rotational direction of the photosensitive drum 165.

In the image forming apparatus 160 having such a configuration, a toner transfer operation between the developing unit 161 and intermediate transfer belt 169 is carried out as follows. Toner is supplied from the toner supply roller 163 to the developing roller 162. At this time, toner amount is controlled by the restricting blade 164. The developing roller 162 develops a latent image on the photosensitive drum 165 formed by the line head 167 and the like. The developed image on the photosensitive drum 165 is transferred to the intermediate transfer belt 169.

A plurality of feeding rollers, a pair of discharging rollers 176, and the like are provided along the sheet feeding path 174 along which the recording sheet is fed. A single-side image (toner image) carried on the intermediate transfer belt 169 is transferred onto one surface of the recording sheet at the position of a secondary transfer roller 171. The secondary transfer roller 171 comes into contact with or is separated from the intermediate transfer belt 169 by a clutch. When the clutch is turned on, the secondary transfer roller 171 comes into contact with the intermediate transfer belt 169 so that the image is transferred onto the recording sheet.

Then, a fixing process is performed on the recording sheet having the image transferred thereon by the fixing roller T having the heater H. The fixing roller T is provided with the heating roller 172 and reversed crown shaped pressure roller 173. After the fixing process, the recording sheet is pulled by the sheet discharge roller unit 3 so as to be transferred in the direction of an arrow F. In this state, when the sheet discharge roller unit 3 rotates in the opposite direction to reverse the sheet feeding direction, the sheet passes through a double side printing feeding path (double-side feeding path) 175 in the direction of an arrow G. A reference numeral 183 denotes first double side rollers, 184 denotes second double side rollers, 177 denotes an electric component box, 178 denotes a sheet supply tray for storing the recording sheet S, 179 denotes a pick-up roller provided at the outlet of the sheet supply tray 178. An exhaust fan 191 is provided in a housing case 190. An openable cover 190*a* for pulling out a jammed recording sheet S is formed on the sheet feeding path 174 side of the housing case 190.

Feeding rollers 181 are provided along the sheet feeding path 174 for single side printing on the sheet feeding downstream side relative to the pick-up roller 179. Further, gate rollers 180 are provided on the sheet feeding direction upstream side relative to the secondary transfer roller 171.

In place of the line head 167 using a light-emitting device as an exposure means shown in the example of FIG. 9, a scanning optical system using a laser light as a light source may be provided.

As described above, according to the post-fixing support unit according to the present invention and the image forming apparatus using the post-fixing support unit, occurrence of folding, puckering, wrinkling, and the like on the recording sheet S can be suppressed.

Although the post-fixing support unit and image forming apparatus using the post-fixing support unit according to the embodiments of the present invention have been shown and described, the present invention is not limited to the above embodiments, and various modifications may be made without departing from the scope of the present invention.

What is claimed is:

1. A post-fixing support unit which is disposed between a fixing roller including a heating roller having a heat generator and a pressure roller so disposed opposite to the heating roller as to form a nip portion and a plurality of sheet discharge rollers which are disposed on the downstream side relative to the fixing roller and corrugation rollers disposed respectively between the adjacent two sheet discharge rollers, such that the post-fixing support unit is located on the upstream side relative to the corrugation rollers at the same position as at least the corrugation rollers in the width direction.

2. The post-fixing support unit according to claim 1, wherein the post-fixing support unit is disposed near an intersection of a tangent line extending from a nip portion of the fixing roller and tangent line extending from a nip portion of the sheet discharge roller.

3. The post-fixing support unit according to claim 1, comprising a post-fixing support guide.

4. The post-fixing support unit according to claim 1, comprising a post-fixing support roller.

5. The post-fixing support unit according to claim 4, wherein the post-fixing support roller is disposed only on one side of a transfer medium feeding path.

6. The post-fixing support unit according to claim 1, comprising support guide ribs.

7. The post-fixing support unit according to claim 6, wherein the support guide ribs are disposed only on one side of a transfer medium feeding path.

8. An image forming apparatus using a post-fixing support unit as claimed in claim 1, comprising:

an image carrier;

a developer carrier for developing a latent image on the image carrier;

an intermediate transfer member for transferring the image on the image carrier developed by the developer carrier;

a secondary transfer section for transferring the image on the intermediate transfer member onto a transfer medium;

a fixing unit for fixing the image on the transfer medium; and the post-fixing support unit.

* * * * *